US007889166B2

(12) United States Patent
Moon

(10) Patent No.: US 7,889,166 B2
(45) Date of Patent: Feb. 15, 2011

(54) LIQUID CRYSTAL DISPLAY WITH IMPROVED IMAGE QUALITY

(75) Inventor: Seung-Hwan Moon, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 821 days.

(21) Appl. No.: 11/508,601

(22) Filed: Aug. 22, 2006

(65) Prior Publication Data

US 2007/0070018 A1 Mar. 29, 2007

(30) Foreign Application Priority Data

Sep. 29, 2005 (KR) ..... 10-2005-0091253

(51) Int. Cl.
*G09G 3/36* (2006.01)

(52) U.S. Cl. ..... 345/89; 345/88; 345/690

(58) Field of Classification Search ..... 345/690, 345/601, 605, 596; 358/3.13
See application file for complete search history.

(56) References Cited

U.S. PATENT DOCUMENTS

| | | | | |
|---|---|---|---|---|
| 6,353,435 | B2 * | 3/2002 | Kudo et al. | 345/204 |
| 6,809,717 | B2 * | 10/2004 | Asao et al. | 345/102 |
| 7,034,842 | B1 * | 4/2006 | Sato et al. | 345/589 |

FOREIGN PATENT DOCUMENTS

| | | | |
|---|---|---|---|
| JP | 2000-338459 | | 12/2000 |
| JP | 2003-122312 | | 4/2003 |
| JP | 2004-126626 | | 4/2004 |
| JP | 2005-062440 | | 3/2005 |
| JP | 2005-084516 | | 3/2005 |
| JP | 2005-157280 | | 6/2005 |
| JP | 2005-173158 | | 6/2005 |
| KR | 1020030079641 | | 10/2003 |
| KR | 1020040041939 | | 5/2004 |
| KR | 1020050006144 | | 1/2005 |
| KR | 1020050014055 | | 2/2005 |
| KR | 1020050052862 | | 6/2005 |
| KR | 1020050052862 | A * | 7/2005 |
| WO | 2004044880 | A1 | 5/2004 |

* cited by examiner

*Primary Examiner*—Bipin Shalwala
*Assistant Examiner*—Kelly Hegarty
(74) *Attorney, Agent, or Firm*—Innovation Counsel LLP

(57) ABSTRACT

A liquid crystal display with improved color reproducibility and image quality is presented. The liquid crystal display includes a liquid crystal panel assembly including a plurality of pixels, a signal controller, and a data driver. The signal controller stores a dithering data patterns, selects one of the dithering data patterns based on input image data having a first bit number, and converts the input image data to output image data having a different bit number using the selected dithering data pattern. The data driver applies data voltages to the pixels, the data voltages corresponding to the output image data from the signal controller. Frequency of the input image signal and the output image signal from the signal controller is each about 120 Hz, and the dithering data patterns are repeated every eight frames. The signal controller includes a look-up table that stores the dithering data patterns.

16 Claims, 3 Drawing Sheets

LIQUID CRYSTAL DISPLAY WITH IMPROVED IMAGE QUALITY

CROSS-REFERENCE TO RELATED APPLICATION

This application claims priority to and the benefit of Korean Patent Application No. 10-2005-0091253 filed in the Korean Intellectual Property Office on Sep. 29, 2005, the entire content of which is incorporated herein by reference.

BACKGROUND OF THE INVENTION (a) Field of the Invention

The present invention relates to a liquid crystal display.

(b) Description of the Related Art

An LCD includes two panels having pixel electrodes and a common electrode, and a liquid crystal (LC) layer with dielectric anisotropy that is interposed between the two panels. The pixel electrodes are arranged in a matrix and connected to switching elements such as thin film transistors (TFTs) that supply them with data voltages. The common electrode covers substantially the entire surface of one of the two panels and is supplied with a common voltage. The pixel electrode, the common electrode, and the LC layer form an LC capacitor. The LC capacitor is a basic element of a pixel along with the switching element connected thereto.

In the LCD, the pixel electrode and the common electrode generate an electric field in the LC layer when a voltage is applied. Light transmittance through the LC layer is adjusted by controlling the strength of the electric field, thereby obtaining desired images.

The display device receives digital input image data for primary colors such as red, green, and blue from an external graphics source. A signal controller of the display device appropriately processes the input image data and supplies the processed image data to a data driver implemented as an IC (integrated circuit) chip, etc. The data driver converts the digital image data into analog data voltages and applies the data voltages to the pixels.

Often, the bit number of the input image data from the graphics source does not match that of the image data that can be processed by the data driver. For example, a data driver that is capable of processing only 10-bit data is commonly used for reducing the manufacturing cost when the bit number of the input image data is thirteen.

In order to convert the 13-bit image data into the 10-bit image data that is capable of being processed by the data driver, it is proposed that dithering be applied for use in the display device. The dithering represents high-bit data as low-bit data, and translates their temporal and spatial arrangements to fit the 10-bit data format. During the dithering process, the signal controller modifies high-bit input data in a frame for a pixel into low-bit data depending on the position of the pixel and the serial number of the frame. This modification is done according to the dithering data pattern stored in a memory such as a frame memory. Dithering data pattern includes the pattern to be used to modify data as a function of the position of the pixel and the serial number of the frame.

Manufacturing cost is decreased by using the dithering data patterns. However, as there are fewer number of bits that represent grays of images, color reproducibility is compromised. The decreased number of gray levels results in a decreased number of colors represented.

SUMMARY OF THE INVENTION

A motivation of the present invention is to solve the problems of conventional techniques.

In one aspect, the present invention is a liquid crystal display device that includes a display panel including a plurality of pixels, a signal controller, and a data driver. The signal controller stores a plurality of dithering data patterns including data elements having a first value or a second value, selects one of the dithering data patterns based on input image data having a first bit number, and converts the input image data into output image data having a second bit number that is smaller than the first bit number based on the selected dithering data pattern. The data driver applies data voltages to the pixels. The data voltages correspond to the output image data supplied from the signal controller, wherein the frequency of the input image signal and the output image signal from the signal controller is each about 120 Hz, and the dithering data patterns are repeated every eight frames.

BRIEF DESCRIPTION OF THE DRAWINGS

The present invention will become more apparent by describing preferred embodiments thereof in detail with reference to the accompanying drawings in which.

DETAILED DESCRIPTION OF THE EMBODIMENTS

Figure 1:
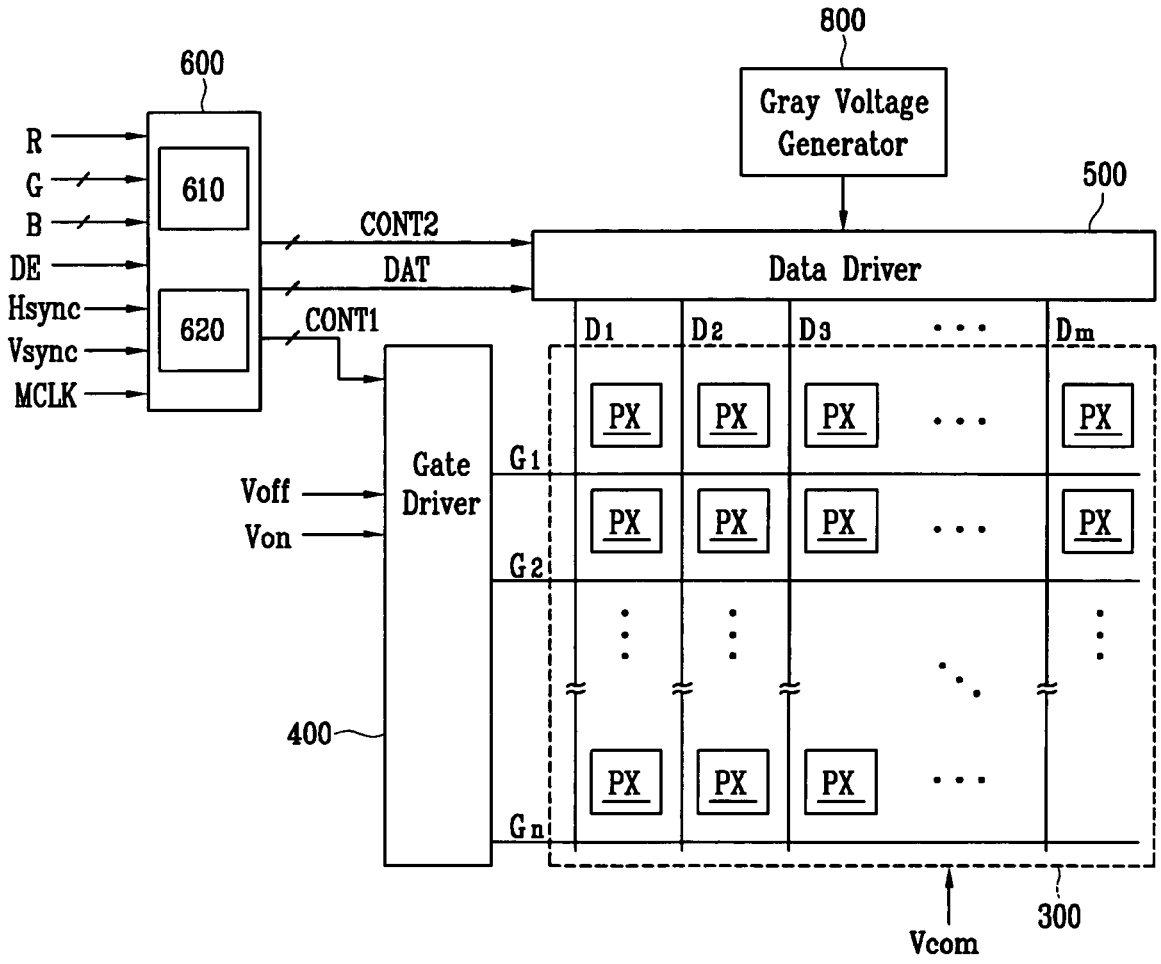
FIG. 1 is a block diagram of an LCD according to an embodiment of the present invention.

The present invention now will be described more fully hereinafter with reference to the accompanying drawings that show embodiments of the invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present.

A liquid crystal display according to an embodiment of the present invention will now be described with reference to the accompanying drawings.

An LCD according to an embodiment of the present invention will be described with reference to FIGS. 1 and 2.

Figure 2:
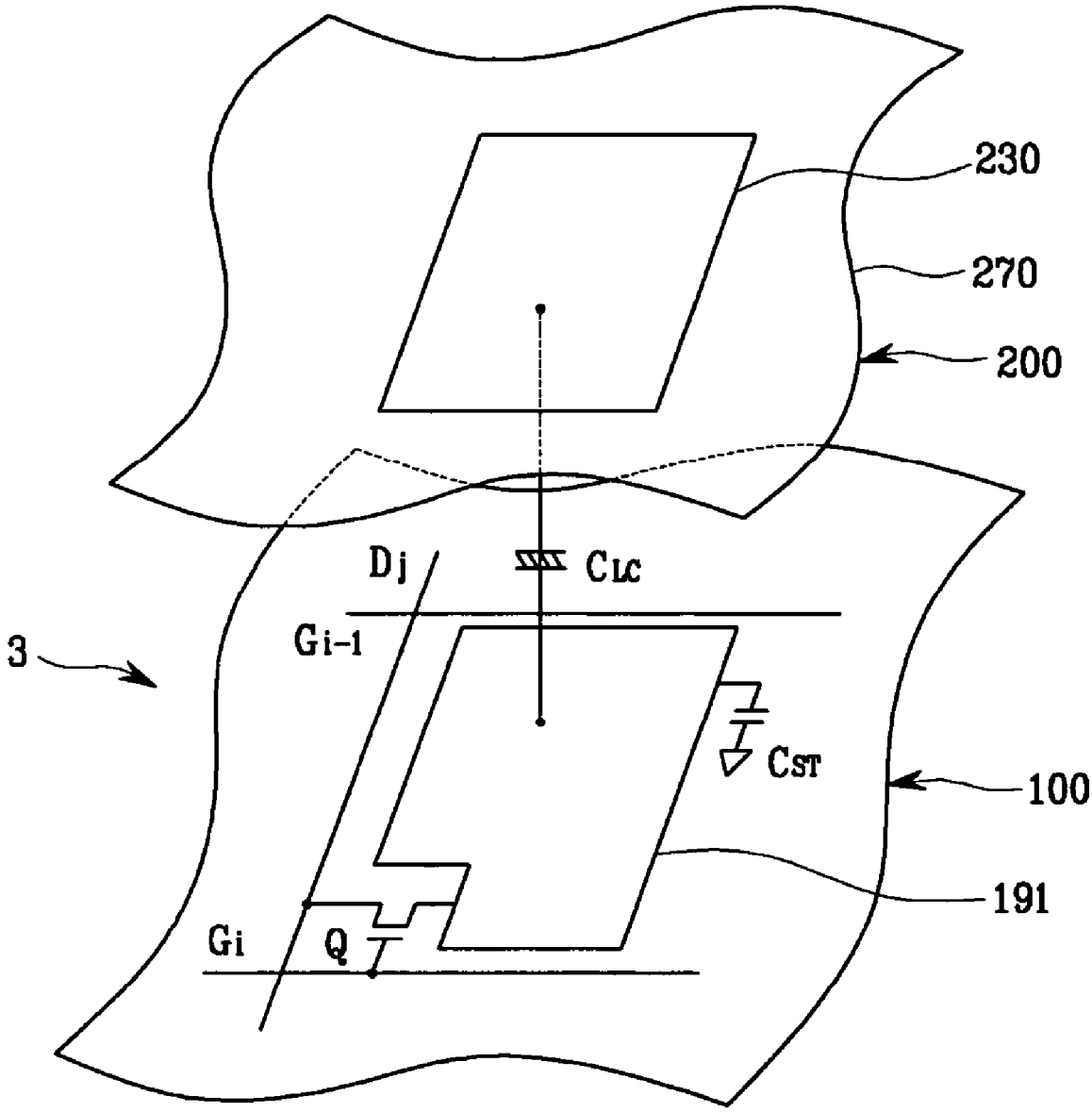
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment of the present invention includes an LC panel assembly 300, a gate driver 400 and a data driver 500 connected thereto, a gray voltage generator 800 connected to the data driver 500, and a signal controller 600 for controlling the above-described elements.

The LC panel assembly 300, in a structural view shown in FIG. 2, includes a lower panel 100, an upper panel 200, and a liquid crystal layer 3 interposed therebetween. The lower panel 100 further includes a plurality of signal lines $G_1$-$G_n$ and $D_1$-$D_m$ and a plurality of pixels PX connected thereto. The pixels PX are arranged substantially in a matrix formation in the circuital views of FIGS. 1 and 2.

The signal lines $G_1$-$G_n$ and $D_1$-$D_m$ are provided on the lower panel 100 and include a plurality of gate lines $G_1$-$G_n$ for transmitting gate signals (called scanning signals) and a plurality of data lines $D_1$-$D_m$ for transmitting data signals. The gate lines $G_1$-$G_n$ extend substantially in a row direction and are substantially parallel to each other, while the data lines $D_1$-$D_m$ extend substantially in a column direction and are substantially parallel to each other.

Referring to FIG. 2, each pixel PX, for example, a pixel PX connected to the i-th gate line $G_i$(i=1, 2, . . . , n) and the j-th data line $D_j$ (j=1, 2, . . . , m) includes a switching element Q connected to the signal lines $G_1$-$G_n$ and $D_1$-$D_m$, and an LC capacitor $C_{LC}$ and a storage capacitor $C_{ST}$ that are connected to the switching element Q. The storage capacitor $C_{ST}$ may be omitted in some embodiments.

The switching element Q such as a TFT is provided on the lower panel 100 and has three terminals: a control terminal connected to one of the gate lines $G_1$-$G_n$; an input terminal connected to one of the data lines $D_1$-$D_m$; and an output terminal connected to the LC capacitor $C_{LC}$ and the storage capacitor $C_{ST}$.

The LC capacitor $C_{LC}$ includes a pixel electrode 191 provided on the lower panel 100 and a common electrode 270 provided on the upper panel 200, as two terminals. The LC layer 3 disposed between the two electrodes 191 and 270 functions as a dielectric of the LC capacitor $C_{LC}$. The pixel electrode 191 is connected to the switching element Q. The common electrode 270 is supplied with a common voltage Vcom and covers substantially the entire surface of the upper panel 200. Unlike in the embodiment of FIG. 2, the common electrode 270 may be provided on the lower panel 100, and both electrodes 191 and 270 may be shaped into bars or stripes.

The storage capacitor $C_{ST}$ is an auxiliary capacitor for the LC capacitor $C_{LC}$. The storage capacitor $C_{ST}$ includes the pixel electrode 191 and a separate signal line (not shown), which is provided on the lower panel 100, overlaps the pixel electrode 191 without establishing an electrical connection. The storage capacitor $C_{ST}$ is supplied with a predetermined voltage such as the common voltage Vcom. Alternatively, the storage capacitor $C_{ST}$ includes the pixel electrode 191 and an adjacent gate line (called a previous gate line) that overlaps the pixel electrode 191 without establishing an electrical connection.

For color display, each pixel PX uniquely represents a primary color (i.e., spatial division) or each pixel PX sequentially represents the primary colors in turn (i.e., temporal division), such that a spatial or temporal sum of the primary colors is recognized as a desired color. An example of a set of the primary colors includes red, green, and blue colors. FIG. 2 shows an example of the spatial division in which each pixel PX includes a color filter 230 representing a primary color in an area of the upper panel 200 facing the pixel electrode 191. In some embodiments, the color filter 230 is provided on or under the pixel electrode 191 on the lower panel 100.

One or more polarizers (not shown) are attached to at least one of the panels 100 and 200.

Referring to FIG. 1, the gray voltage generator 800 generates two sets of gray voltages related to the transmittance of the pixels PX. The gray voltages in one set have a positive polarity with respect to the common voltage Vcom, while those in the other set have a negative polarity with respect to the common voltage Vcom.

The gate driver 400 is connected to the gate lines $G_1$-$G_n$ of the panel assembly 300 and synthesizes the gate-on voltage Von and the gate-off voltage Voff from an external device to generate gate signals for application to the gate lines $G_1$-$G_n$.

The data driver 500 is connected to the data lines $D_1$-$D_m$ of the panel assembly 300. The data driver 500 selects data voltages from the gray voltages supplied by the gray voltage generator 800 and applies the selected data voltages to the data lines $D_1$-$D_m$. The gray voltage generator 800 generates a plurality of gray voltages related to the transmittance of the pixels PX. However, the gray voltage generator 800 may generate only a given number of gray voltages (referred to as reference gray voltages) instead of generating all of the possible gray voltages.

The signal controller 600 includes a data processor 610 and a look-up table 620, and controls the gate driver 400 and data driver 500, etc. The look-up table 620 stores the dithering data patterns for dithering.

Each of the processing units 400, 500, 600, and 800 may include at least one integrated circuit (IC) chip mounted on the LC panel assembly 300 or on a flexible printed circuit (FPC) film as a tape carrier package (TCP) type, and is attached to the panel assembly 300. Alternately, at least one of the processing units 400, 500, 600, and 800 may be integrated with the panel assembly 300 along with the signal lines $G_1$-$G_n$ and $D_1$-$D_m$ and the switching elements Q. As a further alternative, all the processing units 400, 500, 600, and 800 may be integrated into a single IC chip, but at least one of the processing units 400, 500, 600, and 800 or at least one circuit element of at least one of the processing units 400, 500, 600, and 800 may be disposed outside of the single IC chip.

Now, the operation of the LCD will be described in detail.

The signal controller 600 is supplied with input image signals R, G, and B and input control signals for controlling the display thereof from an external graphics controller (not shown). The input image signals R, G, and B contain luminance information for the pixels PX identifying which of the predetermined number of (for example, 1024(=$2^{10}$), 256(=$2^8$), or 64(=$2^6$)) grays to apply. The input control signals include a vertical synchronization signal Vsync, a horizontal synchronization signal Hsync, a main clock signal MCLK, and a data enable signal DE.

On the basis of the input control signals and the input image signals R, G, and B, the signal controller 600 generates gate control signals CONT1 and data control signals CONT2 and it processes the image signals R, G, and B to be suitable for the operation of the panel assembly 300 and the data driver 500. The signal controller 600 sends the scanning control signals CONT1 to the gate driver 400, and sends the processed image signals DAT and the data control signals CONT2 to the data driver 500.

The data processing of the signal controller 600 includes dithering using the dithering data patterns stored in the lookup table 620. The dithering process takes upper bits of the input image data and causes remaining lower bits to be represented as temporal and spatial arrangements of those upper bits when the bit number of image data that is capable of being processed by the data driver 500 is smaller than that of the input image data R, G, and B. For example, when the bit number of the input image data R, G, and B is eight and the bit number of image data that is capable of being processed by the data driver 500 is six, the signal controller 600 may convert the 8-bit image data in a frame for a pixel into 6-bit image data that has a value equal to or larger by one than the upper six bits of the 8-bit image data. This value is determined by two lower bits of the 8-bit image data, the position of the pixel, and the serial number of the frame. The dithering process will be described below in detail.

The gate control signals CONT1 include a scanning start signal STV for instructing to start scanning and at least one clock signal for controlling the output time of the gate-on voltage Von. The gate control signals CONT1 may further include an output enable signal OE for defining the duration of the gate-on voltage Von.

The data control signals CONT2 include a horizontal synchronization start signal STH for informing of start of data transmission for a group of pixels PX, a load signal LOAD for instructing to apply the data voltages to the data lines $D_1$-$D_m$, and a data clock signal HCLK. The data control signal CONT2 may further include an inversion signal RVS for reversing the polarity of the data voltages (with respect to the common voltage Vcom).

Responsive to the data control signals CONT2 from the signal controller 600, the data driver 500 receives a packet of the image data DAT for the group of pixels PX from the signal controller 600, and receives one of the two sets of the gray voltages from the gray voltage generator 800. The data driver 500 converts the image data DAT into analog data voltages selected from the gray voltages and applies the data voltages to the data lines $D_1$-$D_m$.

The gate driver 400 applies the gate-on voltage Von to the gate line $G_1$-$G_n$ in response to the gate control signals CONT1 from the signal controller 600, thereby turning on the switching elements Q connected thereto. The data voltages applied to the data lines $D_1$-$D_m$ are supplied to the pixels PX through the activated switching elements Q.

A difference between the data voltage and the common voltage Vcom is represented as a voltage across the LC capacitor $C_{LC}$, which is referred to as a pixel voltage. The LC molecules in the LC capacitor $C_{LC}$ have orientations depending on the magnitude of the pixel voltage, and the molecular orientations determine the polarization of light passing through the LC layer 3. The polarizer(s) converts the light polarization into light transmittance such that the pixels PX display the luminance represented by the image data DAT.

By repeating this procedure by a unit of a horizontal period (also referred to as "1H" and being equal to one period of the horizontal synchronization signal Hsync and the data enable signal DE), all gate lines $G_1$-$G_n$ are sequentially supplied with the gate-on voltage Von, thereby applying the data signals to all pixels PX of an image for a frame. When the next frame starts after one frame finishes, the inversion control signal RVS applied to the data driver 500 is controlled such that the polarity of the data signals is reversed (which is referred to as "frame inversion"). The inversion control signal RVS may also be controlled such that the polarity of the data signals flowing in a data line are periodically reversed during one frame (for example, row inversion and dot inversion), or the polarity of the data signals in one packet are reversed (for example, column inversion and dot inversion).

The dithering control of the data processor 610 of the signal controller 600 according to embodiments of the present invention is now described in detail with reference to FIG. 3 and FIG. 1.

Figure 3:
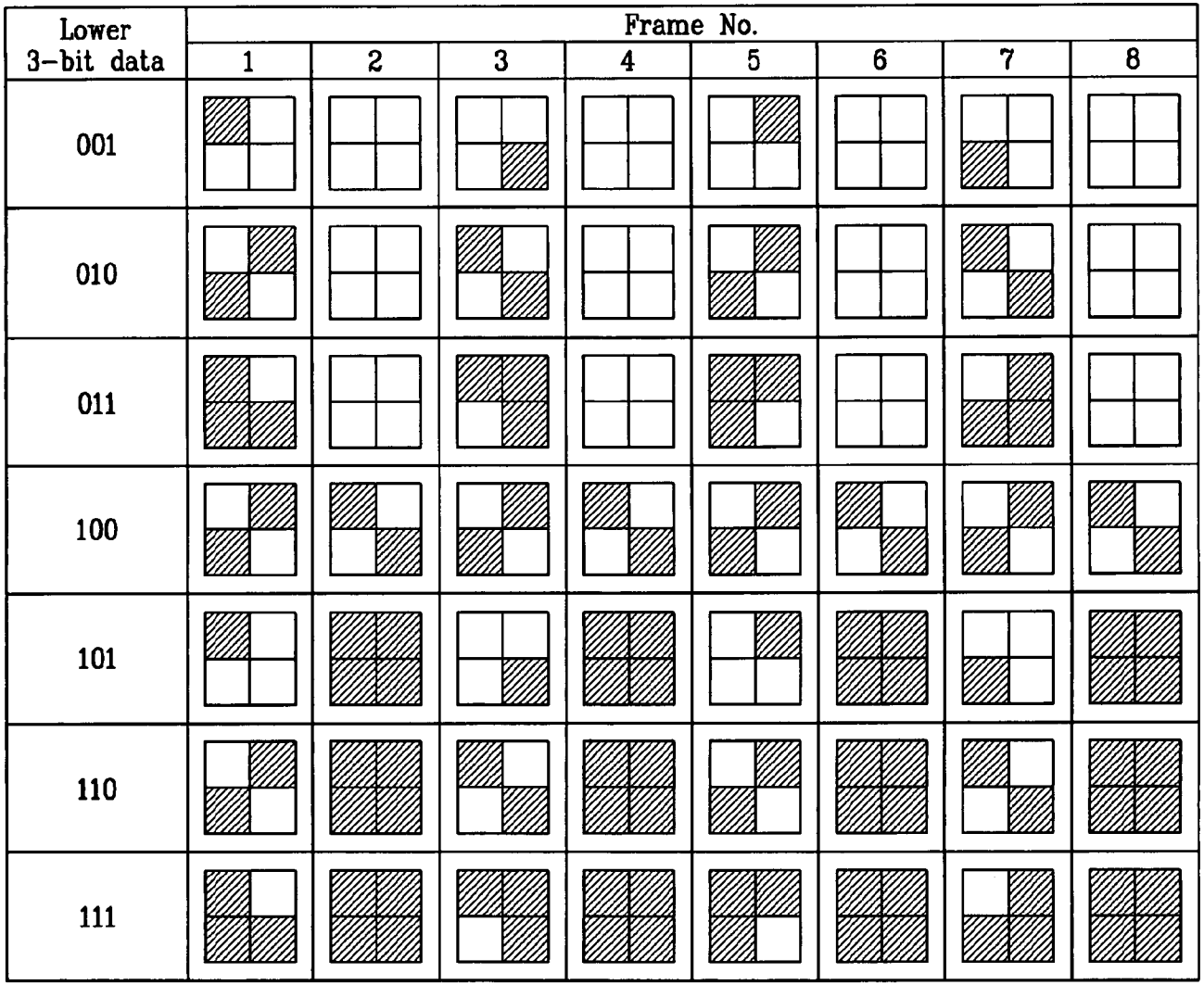
FIG. 3 shows dithering data patterns according to embodiments of the preset invention.

FIG. 3 shows sets of dithering data patterns according to embodiments of the preset invention.

In an embodiment of the present invention, the frame frequency is about 120 Hz such that the signals inputted into or outputted from the signal controller 600 have a frequency of about 120 Hz. That is, the frequency of the input image signal R, G, and B is about 120 Hz and the frequency of the output image signal DAT is also about 120 Hz. The time of one frame is about 8.4 ms.

FIG. 3 shows sets of dithering data patterns according to embodiments of the present invention.

The dithering data pattern sets shown in FIG. 3 are stored in the lookup table 620 of the signal controller 600.

Each of the dithering data patterns in a dithering data pattern set is determined by a value of the lower 3-bit data of input image data and the serial number of the frames. The dithering data patterns are given for eight consecutive frames and seven values "001," "010" "011", "100", "101", "110", and "111" of the lower 3-bit data and thus the total number of the dithering data patterns in the dithering data pattern set is 56. There is no dithering data pattern for "000" of the lower 3-bit data.

Referring to FIG. 3, each dithering data pattern is determined by lower 3-bits of input image data R, G, and B and a serial number of a frame of the input image data R, G, and B into a unit of eight frames. The basic unit for a spatial arrangement of each dithering data pattern is a 2×2 data matrix including data elements, and this means that the dithering data pattern is repeatedly applied to the pixels by a 2×2 pixel matrix. Each data element has a value of one or zero. In the figures, white or blank blocks denote the data elements having the value of zero and the hatched blocks denote the data elements having the value of one.

For given input image data R, G, and B for a pixel, the signal processor 610 of the signal controller 600 selects one image data from the dithering data patterns based on the lower 3-bits of the input image data R, G, and B and the frame number. The signal processor 610 of the signal controller 600 reads the value of one of the four data elements of the selected dithering data pattern corresponding to the position of the pixel. Based on the read value of the data element, the signal controller 600 determines an output image data to be supplied to the data driver 500.

In detail, when the read data element value is zero, the data processor 610 determines that an output gray is equal to the gray represented by the upper ten bits of the input image data R, G, and B. On the contrary, when the read data value is one, the data processor 610 determines that an output gray is obtained by adding one to the gray represented by the upper ten bits of the input image data R, G, and B. The signal controller 600 outputs ten-bit image data DAT representing the output gray to the data driver 500.

When the lower 3-bits of the input image data R, G, and B is equal to "000," the data processor 610 determines that an output gray is equal to the gray represented by the upper ten bits of the input image data R, G, and B without accessing the lookup table 620.

The dithering data patterns shown in FIG. 3 will now be described in detail.

When the lower 3-bit data is "001", "010", and "011," respectively, the data element values of the dithering data patterns of the even-numbered frames are "0", but the values of the dithering data patterns of the odd-numbered frames are determined based on the lower 3-bit data.

That is, when the lower 3-bit data is "001," ¾, i.e., three data elements of four data elements in each dithering data pattern of first, third, fifth, and seventh frames have the data value of "0" and the remaining one data element has the data value of "1". When the lower 3-bit data is "010," ⅔, i.e., two data elements of the four data elements in each dithering data pattern of the first, third, fifth, and seventh frames have the data value of "0" and the remaining two data elements have the data value of "1," and when the lower 3-bit data is "011," ¼, i.e., one data element of four data elements in each dithering data pattern of the first, third, fifth, and seventh frames has the data value of "0" and the remaining three data elements have the data value of "1".

When the lower 3-bit data is "100," ¾, i.e., two data elements of four data elements in each dithering data pattern of all the frames have the data value of "0," and the remaining two data elements have the data value of "1".

When the lower 3-bit data is "101," "110," and "111," respectively, all the data elements of each dithering data pattern of the even-numbered frames have "1," and the data elements of each dithering data pattern of the odd-numbered frames are changed based on the lower 3-bit data.

That is, when the lower 3-bit data is "101," ¾, i.e., three data elements of four data elements in each dithering data pattern of the first, third, fifth, and seventh frames have the data value of "0" and the remaining one data element has the data value of "1". When the lower 3-bit data is "110," ¾, i.e., two data elements of four data elements in each dithering data pattern of the first, third, fifth, and seventh frames have the data value of "0" and the remaining two data elements have the data value of "1," and when the lower 3-bit data is "011," ¼, i.e., one data element of four data elements in each dithering data pattern of the first, third, fifth, and seventh frames has the data value of "0" and the remaining three data elements have the data value of "1".

As described above, in four of the eight frames, the number of data elements having a "1" or "0" value is dependent on the values of the lower 3-bit data., This rule is referred to as spatial dithering.

Moreover, in the four frames of the eight frames, the number of "1" or "0" value for any one data element is dependent on the values of the lower 3-bit data., This method is sometimes referred to as temporal dithering.

In the meantime, when the lower 3-bit data is "000," all the data element values of the dithering data patterns are "0," and thereby it is unnecessary to store separate dithering data patterns. Therefore, when an image signal R, G, and B of 13-bits is converted into an image signal DAT of 10-bits, the total number of the dithering data patterns is substantially 64. However, but a total of 56 dithering data patterns are stored in the look-up table 620, not counting the four dithering data pattern when the lower 3-bit data is "000".

Now, characteristics of the dithering data patterns shown in FIG. 3 will be described in detail.

Of the fifty-six dithering data patterns shown in FIG. 3, in the even-numbered frames, the dithering data patterns when the lower 3-bit data is "001", "010", and "011," are inverted versions of those when the lower 3-bit data is "101", "110", and "111," respectively. In the odd-numbered frames, the dithering data patterns when the lower 3-bit data is "001," "101", "010," and "110", and "011" and "111" are equivalent to each other.

When the lower 3-bit data is "001" and "101," respectively, the dithering data patterns in the even-numbered frames are different from each other.

In a case where the lower 3-bit data is "010" or "110," respectively, the values of data elements that are diagonally positioned with respect to each other in the dithering data patterns of the odd-numbered frames is the same. The dithering data patterns of first and fifth frames are the same, and the dithering data patterns of third and seventh frames are the same. Furthermore, the dithering data patterns of the first and fifth frames are mirror images with respect to those of the third and seventh frames.

When the lower 3-bit data is "100," the dithering data patterns of the odd-numbered frames are the same, and the dithering data patterns of the even-numbered frames are also the same. Moreover, the dithering data patterns of the odd-numbered frames are mirror images with respect to those of the even-numbered frames.

When the lower 3-bit data is "011" and "111," the dithering data patterns of the odd-numbered frames are different from each other, the dithering data patterns of the first and seventh frames are mirror images of each other, and the dithering data patterns of the third and fifth frames are mirror images of each other.

Structures or order of the dithering data patterns shown in FIG. 3 may be changed by row, column, or frame unit.

According to the present invention, the dithering is operated by eight-frame units using the lower 3-bit data such that the number of colors that can be represented increases. As a result, color reproducibility and overall image quality of a display device are improved.

Furthermore, since the frequency of one frame is about 120 Hz, although the dithering is operated by eight-frame units, the dithering unit frequency is about 15 Hz (=120 Hz/8). Thereby, deterioration of the image quality such as flicker that is caused by the dithering unit frequency of about 15 Hz or less does not occur with the invention.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display device comprising:

a display panel including a plurality of pixels;

a signal controller that stores a plurality of dithering data patterns including data elements having a first value or a second value, selects one of the dithering data patterns based on input image data having a first number of bits, and converts the input image data into output image data having a second number of bits that is smaller than the first number of bits based on the selected dithering data pattern; and a data driver that applies data voltages to the pixels, the data voltages corresponding to the output image data from the signal controller, wherein the dithering data patterns are repeated every eight frames, and each of the dithering data patterns has a 2×2 matrix, and wherein a difference between the first number of bits and the second number of bits is equal to three, and wherein each of the eight dithering data patterns corresponding to each of the lower 3-bit data of the input image data is such that either the dithering data patterns of all odd-numbered frames are the same, or the dithering data patterns of all even-numbered frames are the same.

2. The liquid crystal display device of claim 1, wherein the signal controller comprises: a look-up table that stores the dithering data patterns; and a data processor that converts the input image data to the output image data based on the dithering data patterns stored in the look-up table.

3. The liquid crystal display device of claim 1, wherein the selection of a dithering data pattern corresponding to the input image signal of the dithering data patterns is based on the lower 3-bit data of the input image data and a serial number of frames.

4. The liquid crystal display device of claim 3, wherein when the lower 3-bit data is "000," the data processor determines the upper bit data as the output image data.

5. The liquid crystal display device of claim 3, wherein dithering data patterns of a first frame set when the lower 3-bit data is "001," "010," "011," respectively, are the same as dithering data patterns of the first frame set when the lower 3-bit data is "101," "110," and "111," respectively of the lower 3-bit data.

6. The liquid crystal display device of claim 5, wherein in a second frame set, dithering data patterns when the lower 3-bit data is "001" and "101" are equivalent to dithering data patterns when the lower 3-bit data is "010" and "110," respectively, and also equivalent to dithering data patterns when the lower 3-bit data is "011" and "111," respectively.

7. The liquid crystal display device of claim 5, wherein in the first frame set, dithering data patterns are different from each other when the lower 3-bit data is "001" and "101," respectively.

8. The liquid crystal display device of claim 5, wherein in a the first frame set, dithering data patterns are different from each other when the lower 3-bit data is "011" and "111," respectively.

9. The liquid crystal display device of claim 3, wherein when the lower 3-bit data is "001," "010," and "011," respectively, dithering data patterns of a second frame set are, and when the lower 3-bit data is "101," "110," and "111," respectively, dithering data patterns of the second frame set are equivalent.

10. The liquid crystal display device of claim 9, wherein the dithering data patterns of a first frame set when the lower 3-bit data is "001," "010," and "011," respectively, are equal to the dithering data patterns of the first frame set when the lower 3-bit data is "101," "110," and "111," respectively.

11. The liquid crystal display device of claim 9, wherein the second frame set comprises even-numbered frames.

12. The liquid crystal display device of claim 3, wherein when the lower 3-bit data is "100," dithering data patterns of adjacent frames are mirror images of each other.

13. The liquid crystal display device of claim 12, wherein when the lower 3-bit data is "100," data element values of dithering data patterns that are diagonally located with respect to each other are equivalent.

14. The liquid crystal display device of claim 5, wherein the first frame set comprises odd-numbered frames.

15. The liquid crystal display device of claim 6, wherein the second frame set comprises even-numbered frames.

16. The liquid crystal display device of claim 10, wherein the first frame set comprises odd-numbered frames.

* * * * *